US011817287B1

(12) United States Patent
Xi et al.

(10) Patent No.: US 11,817,287 B1
(45) Date of Patent: Nov. 14, 2023

(54) ROTARY-TRANSMISSION-TARGET MICROFOCUS X-RAY SOURCE AND RAY GENERATION METHOD

(71) Applicant: Beijing Institute of Technology, Beijing (CN)

(72) Inventors: Li Xi, Beijing (CN); Kaiyuan Xue, Beijing (CN); Daining Fang, Beijing (CN)

(73) Assignee: Beijing Institute of Technology, Beijing (CN)

( * ) Notice: Subject to any disclaimer, the term of this patent is extended or adjusted under 35 U.S.C. 154(b) by 0 days.

(21) Appl. No.: 18/316,257

(22) Filed: May 12, 2023

(30) Foreign Application Priority Data

May 13, 2022 (CN) ..... 202210521577.1

(51) Int. Cl.

| | |
|---|---|
| ***H01J 35/10*** | (2006.01) |
| ***H01J 35/06*** | (2006.01) |
| ***H01J 35/20*** | (2006.01) |
| ***H01J 35/14*** | (2006.01) |

(52) U.S. Cl.
CPC ..... *H01J 35/101* (2013.01); *H01J 35/066* (2019.05); *H01J 35/106* (2013.01); *H01J 35/147* (2019.05); *H01J 35/20* (2013.01); *H01J 2235/1026* (2013.01); *H01J 2235/1275* (2013.01)

(58) Field of Classification Search
CPC ..... H01J 35/106; H01J 35/066; H01J 35/101; H01J 35/147; H01J 35/20; H01J 2235/1026; H01J 2235/1275
See application file for complete search history.

(56) References Cited

U.S. PATENT DOCUMENTS

| | | | | |
|---|---|---|---|---|
| 3,737,699 | A | 6/1973 | Gager | |
| 4,145,628 | A | 3/1979 | Iwasaki | |
| 5,592,525 | A | 1/1997 | Reznikov et al. | |
| 2005/0226361 | A1* | 10/2005 | Zhou | G01N 23/046 378/4 |
| 2018/0033582 | A1* | 2/2018 | Hadland | H01J 35/108 |

FOREIGN PATENT DOCUMENTS

CN 107068519 A 8/2017

OTHER PUBLICATIONS

JP 2009-026600 A and it's English translation, Feb. 5, 2009, Aoki et al. (Year: 2009).*

* cited by examiner

*Primary Examiner* — Chih-Cheng Kao
(74) *Attorney, Agent, or Firm* — True Shepherd LLC; Andrew C. Cheng

(57) ABSTRACT

A rotary-transmission-target microfocus X-ray source and an X-ray generation method based on the rotary-transmission-target microfocus X-ray source are provided. The X-ray source comprises a chamber, and an electron beam system is installed in the chamber. The electron beam system is arranged on a same side as an anode target rotating shaft. A motor in a rotary anode target system drives an anode target to rotate through a bevel gear transmission device. The microstructure of a target is designed. An electron beam emitted by the electron beam system vertically bombards the metal target of the rotating anode target. A cooling system is configured to cool the anode target.

9 Claims, 8 Drawing Sheets

ROTARY-TRANSMISSION-TARGET MICROFOCUS X-RAY SOURCE AND RAY GENERATION METHOD

CROSS-REFERENCE TO RELATED APPLICATIONS

This application claims priority to Chinese Patent Application No. 202210521577.1 with a filing date of May 13, 2022. The content of the aforementioned application, including any intervening amendments thereto, is incorporated herein by reference.

TECHNICAL FIELD

The present disclosure relates to the technical field of X-ray sources, and in particular to a rotary-transmission-target microfocus X-ray source and an X-ray generation method.

BACKGROUND

At present, X-ray sources used in industrial CT systems are mainly divided into two types according to the different anode targets: reflecting target X-ray source and transmission target X-ray source. Since a certain inclination angle is formed between a reflection-type target surface and an incident electron beam, a large heat dissipation volume can be realized and accelerated electrons of a high voltage can be withstood. In addition, for some reflecting target X-ray sources, their anode target surfaces are driven to rotate by rotors, thereby further increasing the heat dissipation volume. Reflecting target X-ray sources of this special design are also called "rotary-target X-ray sources". An anode target of the transmission target X-ray source is a very thin film having a target surface vertical to an incident electron beam, which can obtain smaller focus size and larger radiation angle.

SUMMARY

The present disclosure provides a rotary-transmission-target microfocus X-ray source and an X-ray generation method based on the rotary-transmission-target microfocus X-ray source.

In one aspect, an embodiment of the present disclosure provides a rotary-transmission-target microfocus X-ray source, including a chamber, wherein an electron beam system, a rotary anode target system and a cooling system are installed in the chamber, the electron beam system is arranged on a same side as an anode target rotating shaft in the rotary anode target system, a motor in the rotary anode target system drives an anode target to rotate through a bevel gear transmission device, an electron beam emitted by the electron beam system vertically bombards a metal target of the rotating anode target, and the cooling system is configured to cool the anode target.

Preferably, the electron beam system includes a ceramic base and a channel member, a high-voltage tube head is connected to and installed at a rear end of the ceramic base, a cathode, a first anode, and a second anode are sequentially installed coaxially at a front end of the ceramic base, a first focusing lens and a second focusing lens are sequentially installed at a rear end of the channel member, a third focusing lens is installed at a front end of the channel member, all the focusing lens are coaxially arranged, and an electron beam channel coaxial with the cathode is arranged in the channel member.

Preferably, the channel member includes a first channel member, a second channel member is installed at a front end of the first channel member, and the first focusing lens and the second focusing lens are fitted over the first channel member, and the third focusing lens is fitted over a front end of the second channel member;

a first electron beam channel is arranged in the channel member, a second electron beam channel is arranged in the second channel member, and the electron beam channels are coaxially connected.

Preferably, the rotary anode target system includes the bevel gear transmission device installed in the chamber, the motor drives a driving bevel gear to rotate, and a driven bevel gear drives the anode target to rotate.

Preferably, the anode target includes a thermally conductive substrate, and a metal target is arranged on the thermally conductive substrate.

Preferably, the chamber is configured as a one-piece structure.

Preferably, the chamber includes at least two chamber bodies that are detachably connected, and a vacuum system is connected with the chamber bodies.

Preferably, the X-ray source further includes a control system.

Preferably, the cooling system includes a cooling chamber installed in the chamber, a cooling medium is arranged in the cooling chamber, and a water cooling and circulating machine is connected with the cooling chamber and circulates the cooling medium.

In another aspect, an embodiment of the present disclosure provides an X-ray generation method based on a rotary-transmission-target microfocus X-ray source. The method uses the rotary-transmission-target microfocus X-ray source, and the method includes:

keeping the chamber in a vacuum state, connecting a cathode tip to a heating current, and starting to preheat; rotating the anode target constantly at a predetermined speed; and enabling the cooling system; and applying an electric field by using a high-voltage power supply so that an electron beam emitted by the cathode is accelerated to a predetermined electron kinetic energy through the high-voltage electric field; focusing the electron beam by using the first focusing lens, the second focusing lens, and the third focusing lens, and focusing the electron beam, in a predetermined shape and size, to the anode target; bombarding the metal target of the anode target vertically with the electron beam, and converting the bombardment energy of the electron beam into heat energy and X-rays, wherein the X-rays first pass through the anode target and then pass through an X-ray window to irradiate in the shape of a cone beam.

REFERENCE NUMERALS

Figure 1:
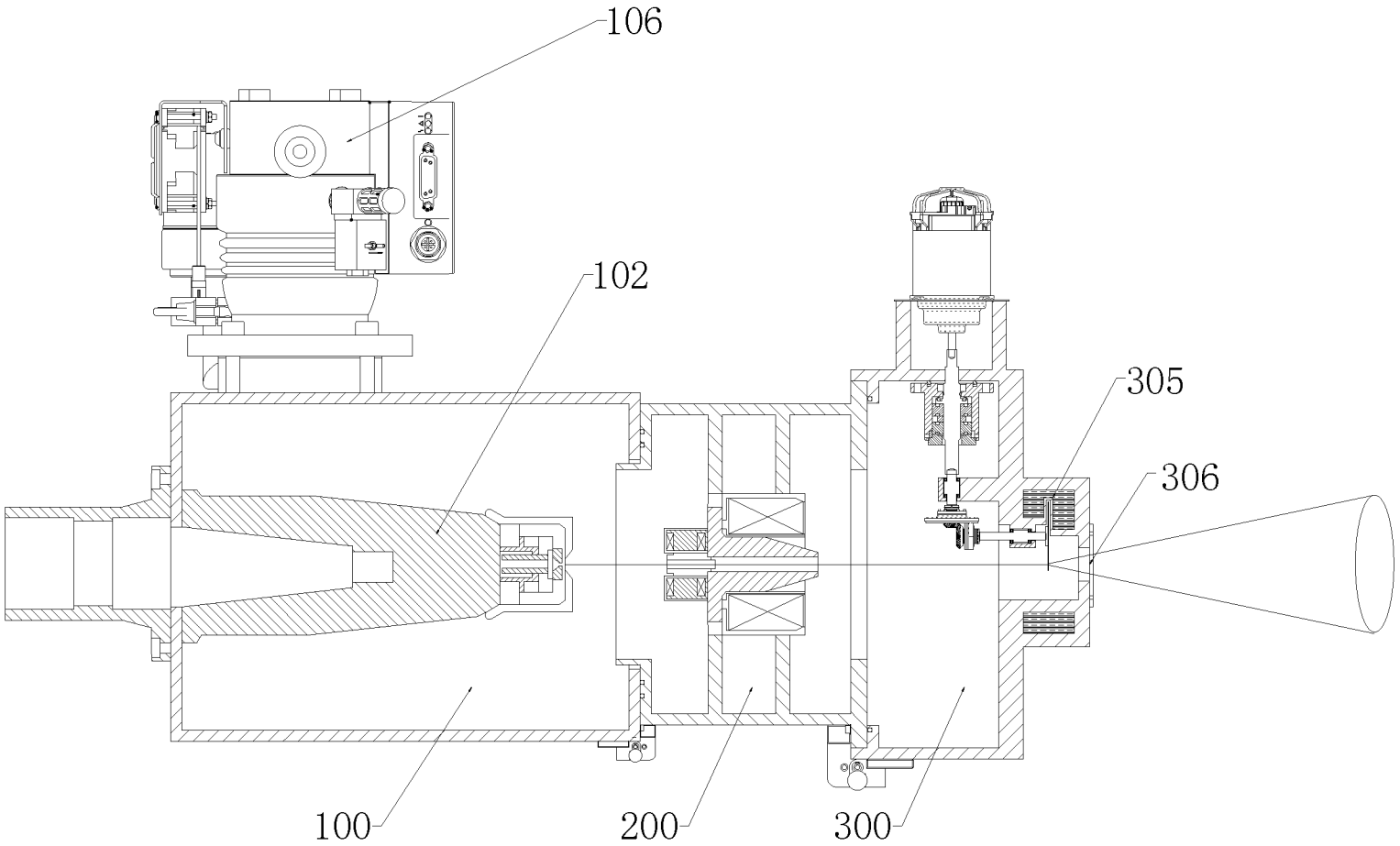
FIG. 1 is a schematic structural diagram showing a rotary-transmission-target microfocus X-ray source according to the present disclosure.

100. first chamber; 200. second chamber; 300. third chamber;

101. head of high-voltage tube; 102. ceramic base; 103. cathode tip; 104. first anode; 105. second anode; 106. vacuum pump/vacuum gauge;

201. first focusing lens; 202. second focusing lens; 203. third focusing lens; 2041. first oxygen-free copper tube; 2042. second oxygen-free copper tube; 2043. first diaphragm; 2044. second diaphragm;

301. anode target; 3011. first surface; 3012. thermally conductive substrate; 3013. metal target; 302. motor; 303. magnetic fluid seal; 304. bevel gear transmission device; 305. cooling chamber; and 306. X-ray window.

DETAILED DESCRIPTION OF EMBODIMENTS

Exemplary embodiments of the present disclosure will be described below in more detail with reference to the accompanying drawings. While the exemplary embodiments of the present disclosure are shown in the drawings, it should be understood that the present disclosure may be implemented in various forms and should not be limited to the embodiments set forth herein. Instead, these embodiments are provided so that the present disclosure will be fully understood and the scope of the present disclosure can be fully conveyed to those skilled in the art.

The existing X-ray sources have the following problems: the transmission type X-ray source has low power, low X-ray flux, long imaging time, and low imaging efficiency; the reflection type X-ray source has a large focus size, a small X-ray emission angle, low imaging resolution, and poor image quality; and since the magnetic field generated by the electromagnetic coil driving the rotor affects the trajectory of the electron beam, the stability of the system is poor, and the X-ray intensity attenuates.

To solve the foregoing technical problems, the present disclosure provides a rotary-transmission-target microfocus X-ray source and an X-ray generation method based on the rotary-transmission-target microfocus X-ray source.

Referring to FIGS. 1-8, an embodiment of the present disclosure provides a rotary-transmission-target microfocus X-ray source, including a chamber, wherein an electron beam system, a rotary anode target system and a cooling system are installed in the chamber, the electron beam system is arranged on a same side as an anode target 301 in the rotary anode target system, a motor 302 in the rotary anode target system drives the anode target 301 to rotate through a bevel gear transmission device 304, an electron beam emitted by the electron beam system vertically bombards the rotating anode target 301, and the cooling system is configured to cool the anode target 301.

Figure 2:
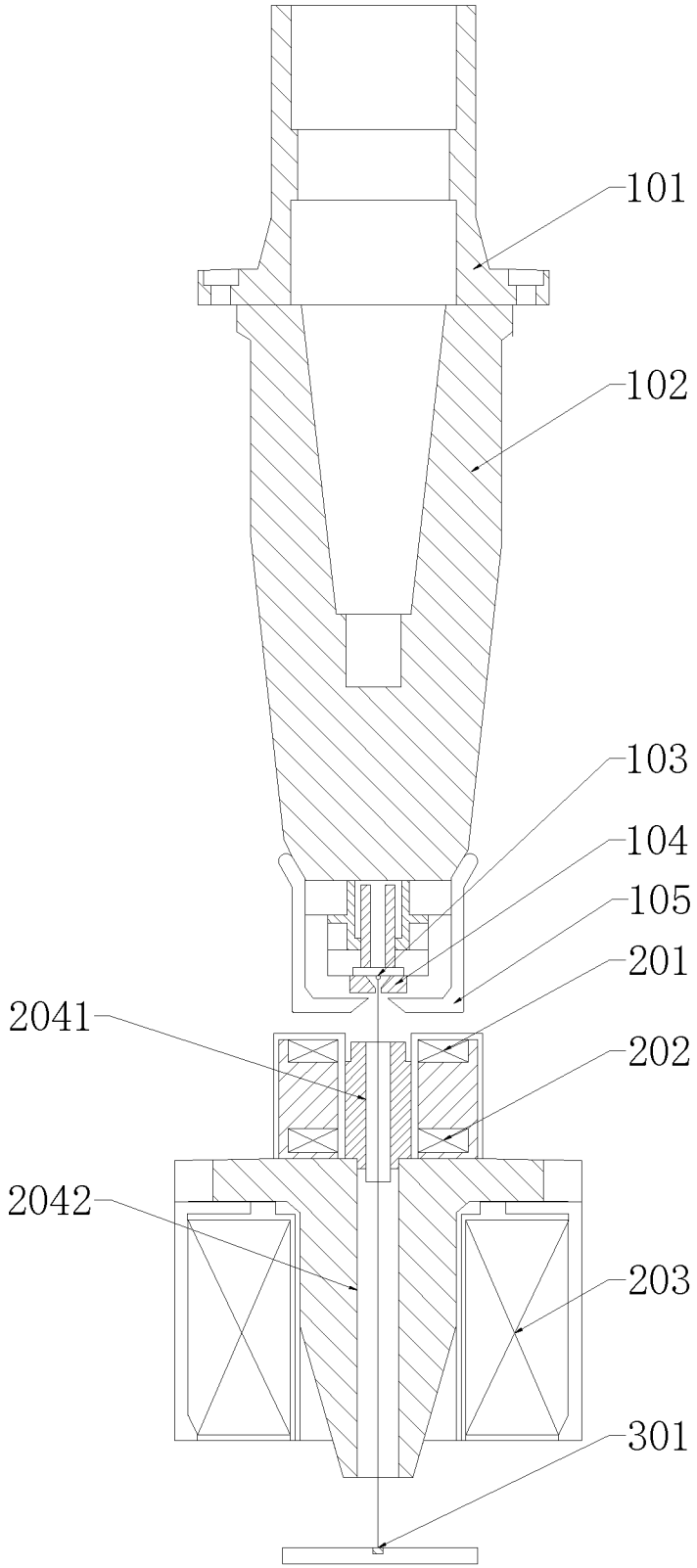
FIG. 2 is a schematic structural diagram showing an electron beam system in the rotary-transmission-target microfocus X-ray source according to the present disclosure.

Referring to FIGS. 1-2, in the embodiment of the present disclosure, the chamber adopts an open design and includes at least two chamber bodies that are detachably connected, and a vacuum system is connected with and installed on the chamber bodies. The chamber includes a first chamber 100, a second chamber 200 and a third chamber 300 that are detachably connected in sequence. Preferably, the first chamber 100, the second chamber 200 and the third chamber 300 are connected by a hinge, sealing rings are used to realize a static vacuum seal, and vacuum grease is regularly applied to the sealing rings between the cavities to ensure the vacuum degree of the system. It is convenient for the replacement of consumables (such as the cathode tip 103 and the anode target 301) and the installation and maintenance of components. In another embodiment of the present disclosure, the chamber adopts a closed design and is configured as a one-piece structure. Specifically, the chamber comprises at least two chamber bodies that are connected, and the chamber bodies are connected by welding, which ensures the high stability of the system and prevents vacuum leakage.

Referring to FIGS. 1-6, in the embodiment of the present disclosure, the electron beam system includes a ceramic base and a channel member, a head of high-voltage tube 101 is connected to and installed at a rear end of the ceramic base 102, the cathode tip, a first anode 104, and a second anode 105 are sequentially installed coaxially at a front end of the ceramic base 102, a first focusing lens 201 and a second focusing lens 202 are sequentially installed at a rear end of the channel member, a third focusing lens 203 is installed at a front end of the channel member, all the focusing lens are coaxially arranged, and an electron beam channel coaxial with the cathode tip is arranged in the channel member. The ceramic base 102 is made of an insulating ceramic material. The ceramic base 102 is installed in the first chamber 100, and the channel member is installed in the second chamber 200, so that the head 101 is located at a tail of the X-ray source device. All parts in the electron beam system are arranged coaxially, so that the central axis of each component installed in the second chamber 200 coincides with the central axis of each component installed in the first chamber 100. The head 101 is connected to a high-voltage power supply. The high-voltage power supply is connected to the head 101 through a high-voltage cable and a flange to provide an electron beam acceleration voltage between the cathode tip and the anode.

Referring to FIGS. 1-2, in another embodiment of the present disclosure, the channel member includes a first oxygen-free copper tube 2041, a second oxygen-free copper tube 2042 is installed at a front end of the first oxygen-free copper tube 2041, the first focusing lens 201 and the second focusing lens 202 are fitted over the first oxygen-free copper tube 2041, the third focusing lens 203 is fitted over a front end of the second oxygen-free copper tube 2042, a first electron beam channel is arranged in the first oxygen-free copper tube 2041, a second electron beam channel is arranged in the second oxygen-free copper tube 2042, and the electron beam channels are coaxially connected.

Specifically, the cathode tip is configured as a LaB6 tip. Optionally, other cathode tip materials include but are not limited to tungsten filament, molybdenum, carbon nanotube, and the like. The cathode tip functions as an electron source.

Specifically, the first anode 104 and the second anode 105 are configured as grid structures. Electrons are induced by the electric field between the first anode 104 and the cathode tip, and then the electric field between the second anode 105 and the cathode tip accelerates the electrons to a predetermined electron kinetic energy and directs the electrons to a first surface 3011 of the anode target.

In the embodiment of the present disclosure, the first focusing lens 201, the second focusing lens 202, and the third focusing lens 203 are electro-optical components, which are powered by a high-precision DC power supply to generate a magnetic field. In another embodiment of the present disclosure, the first focusing lens 201, the second focusing lens 202 and the third focusing lens 203 are configured as electrostatic lenses.

In the embodiment of the present disclosure, the first focusing lens 201, the second focusing lens 202 and the third focusing lens 203 are configured to focus an electron beam, so that the diameter of a beam spot of the electron beam finally reaching the first surface 3011 of the anode target is less than or equal to 30 μm. In another embodiment of the present disclosure, the focal spot diameter is 0.5-10 μm. The third focusing lens 203 of the present disclosure functions as an electron objective lens to finally focus the electron beam on the first surface 3011 of the anode target. The third focusing lens 203 should have a focal length longer than that of the first focusing lens 201 and the second focusing lens 202.

Figure 7:
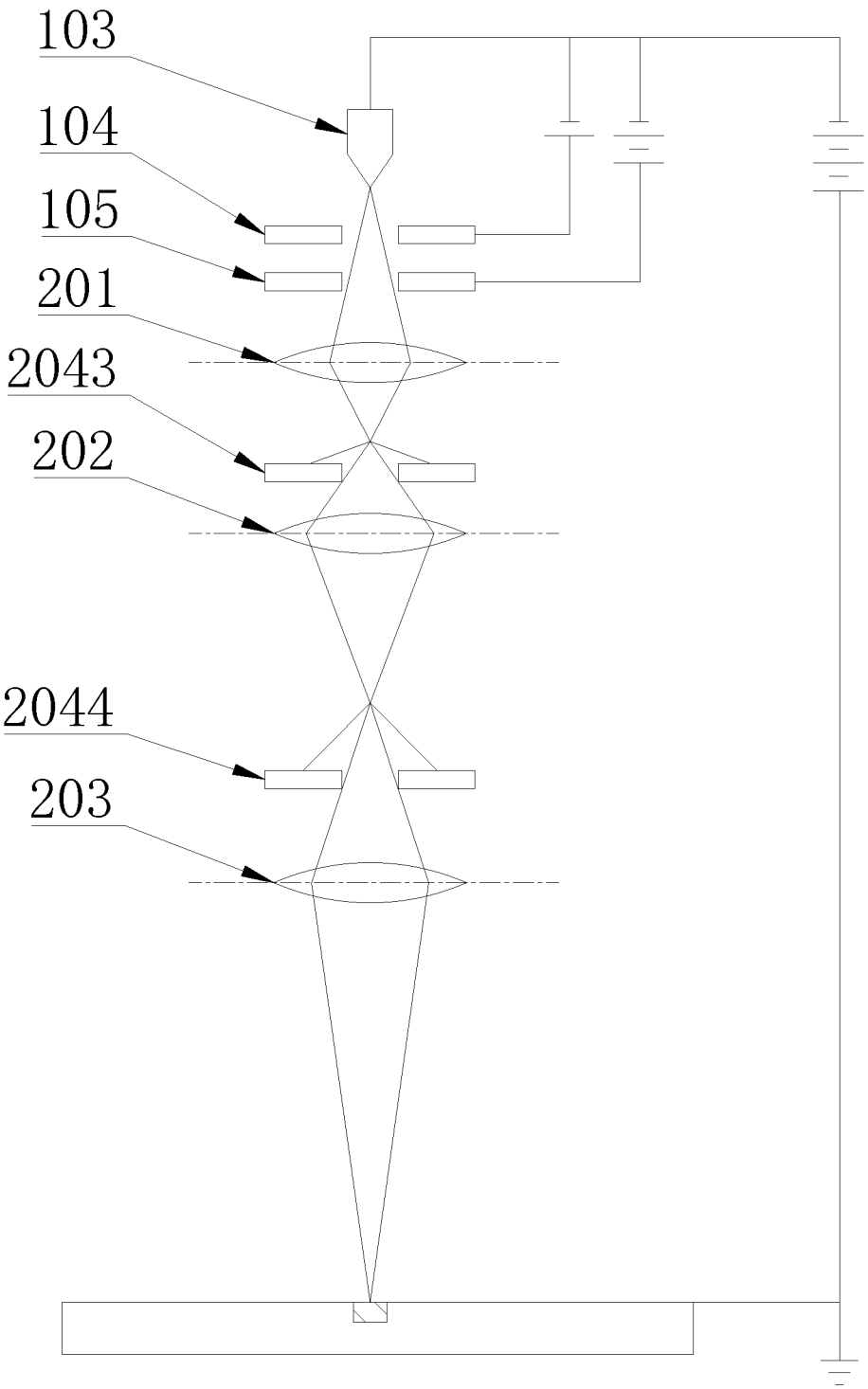
FIG. 7 is a schematic diagram showing the electron beam system in the rotary-transmission-target microfocus X-ray source according to the present disclosure.

In the embodiment of the present disclosure, the oxygen-free copper tubes are used for the electron beam channels to reduce the influence of backscattered electrons and reflected electrons on the stability of the electron beam during the movement of the electron beam. The oxygen-free copper tubes also play a role in filtering/gathering outer electrons. Referring to FIG. 7, in another embodiment of the present disclosure, a first diaphragm 2043 and a second diaphragm 2044 are arranged behind the focal points of the first focusing lens 201 and the second focusing lens 202 to filter the outer electrons.

In the embodiment of the present disclosure, the control system adjusts an output value of a high-precision current source, changes the focusing effect of the electron-optical system on the electron beam, and realizes a dot-form focal spot with an adjustable diameter within a range of 0.5 μm to 30 μm. In another embodiment of the present disclosure, the third focusing lens 203 is configured as a magnetic quadruple lens. The control system adjusts the output value of the high-precision current source so that the electron beam finally forms a linear focal spot on the first surface 3011 of the anode target.

Figure 3:
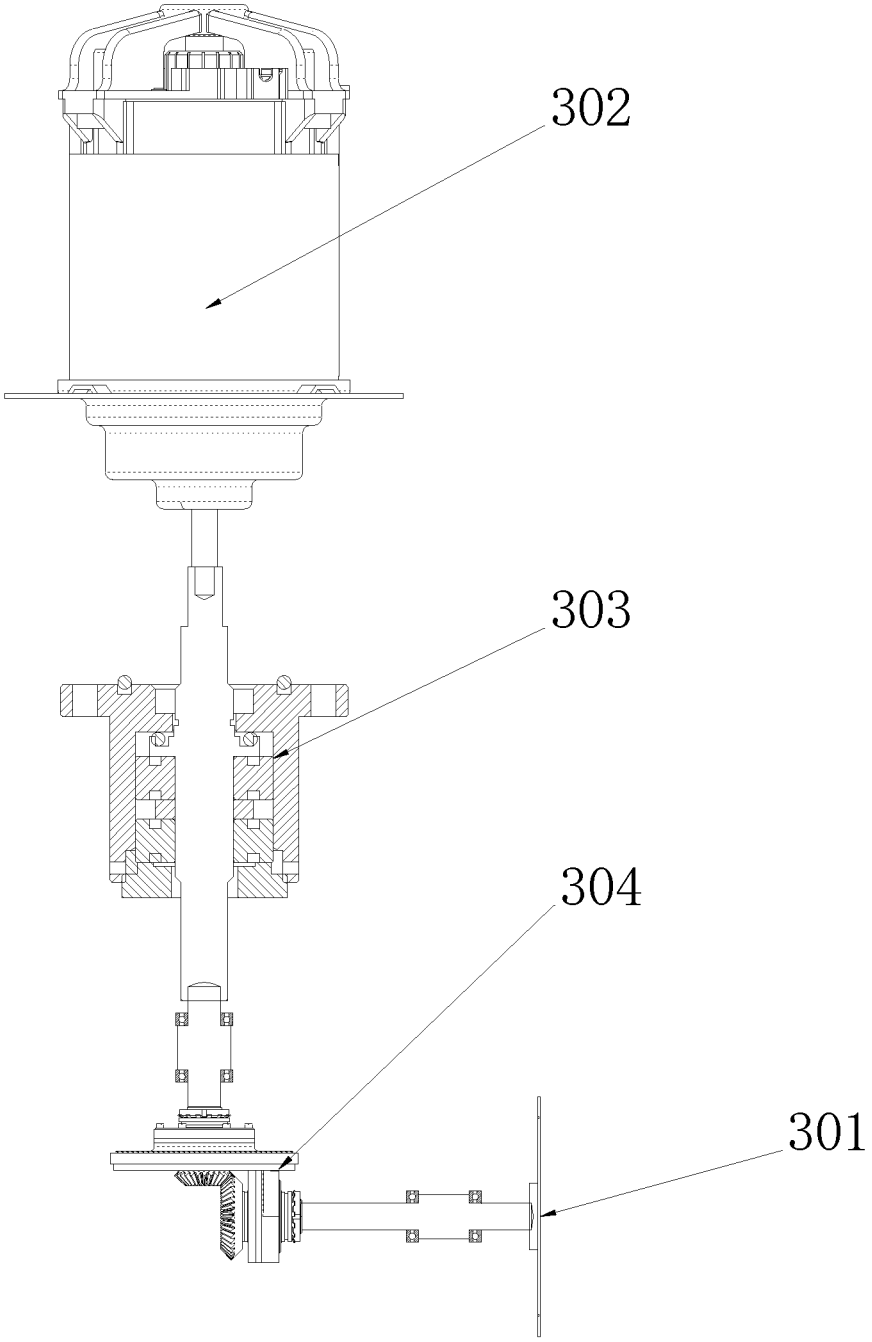
FIG. 3 is a schematic structural diagram showing a rotary anode target system in the rotary-transmission-target microfocus X-ray source according to the present disclosure.
Figure 4:
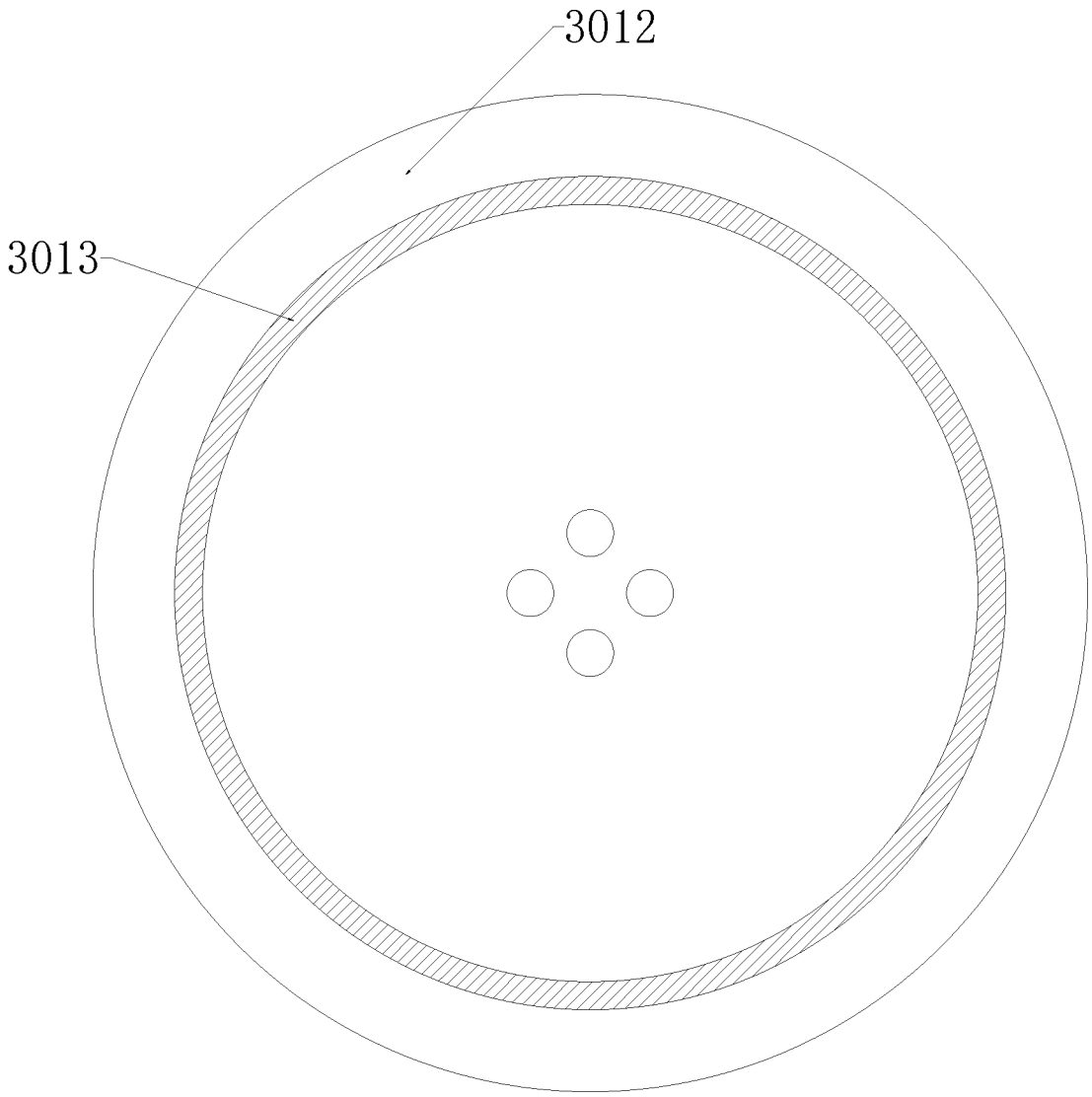
FIG. 4 is a front view showing anode target in the rotary-transmission-target microfocus X-ray source according to the present disclosure.
Figure 5:
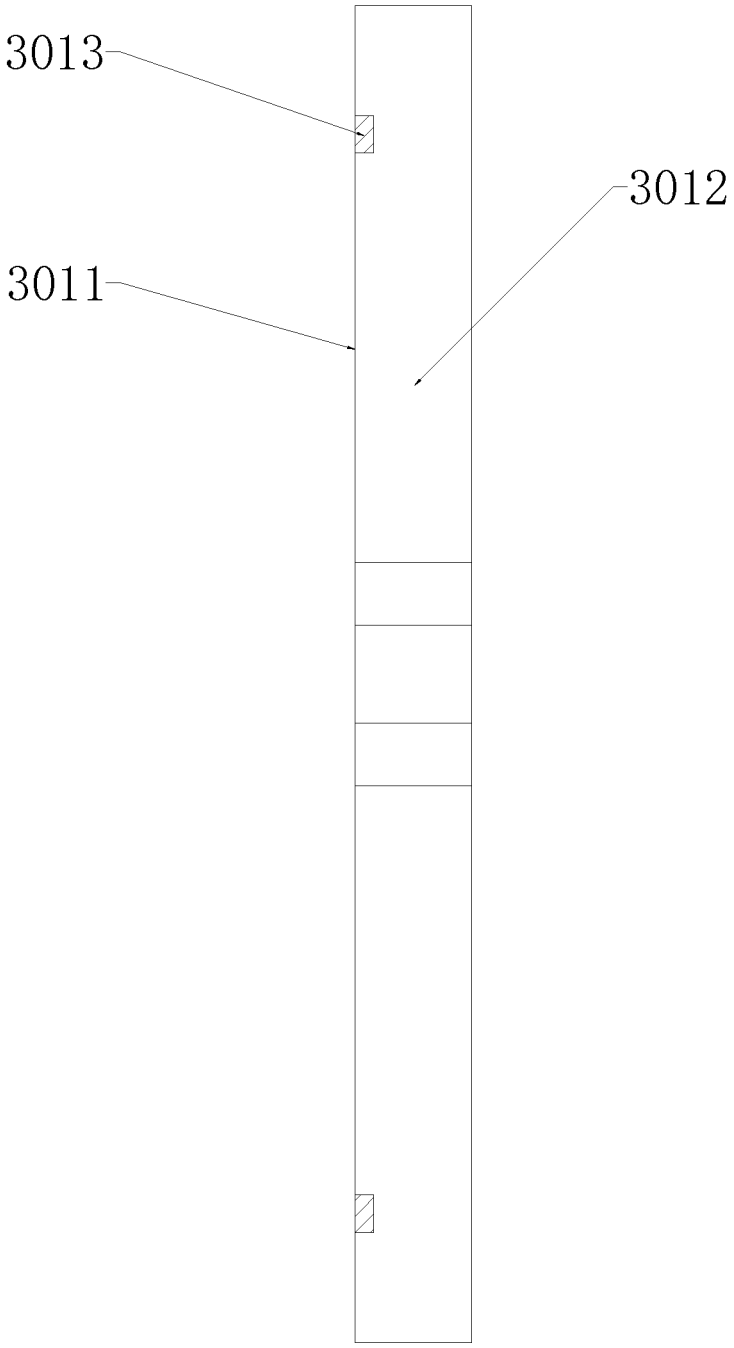
FIG. 5 is a left view showing the anode target in the rotary-transmission-target microfocus X-ray source according to the present disclosure.
Figure 6:
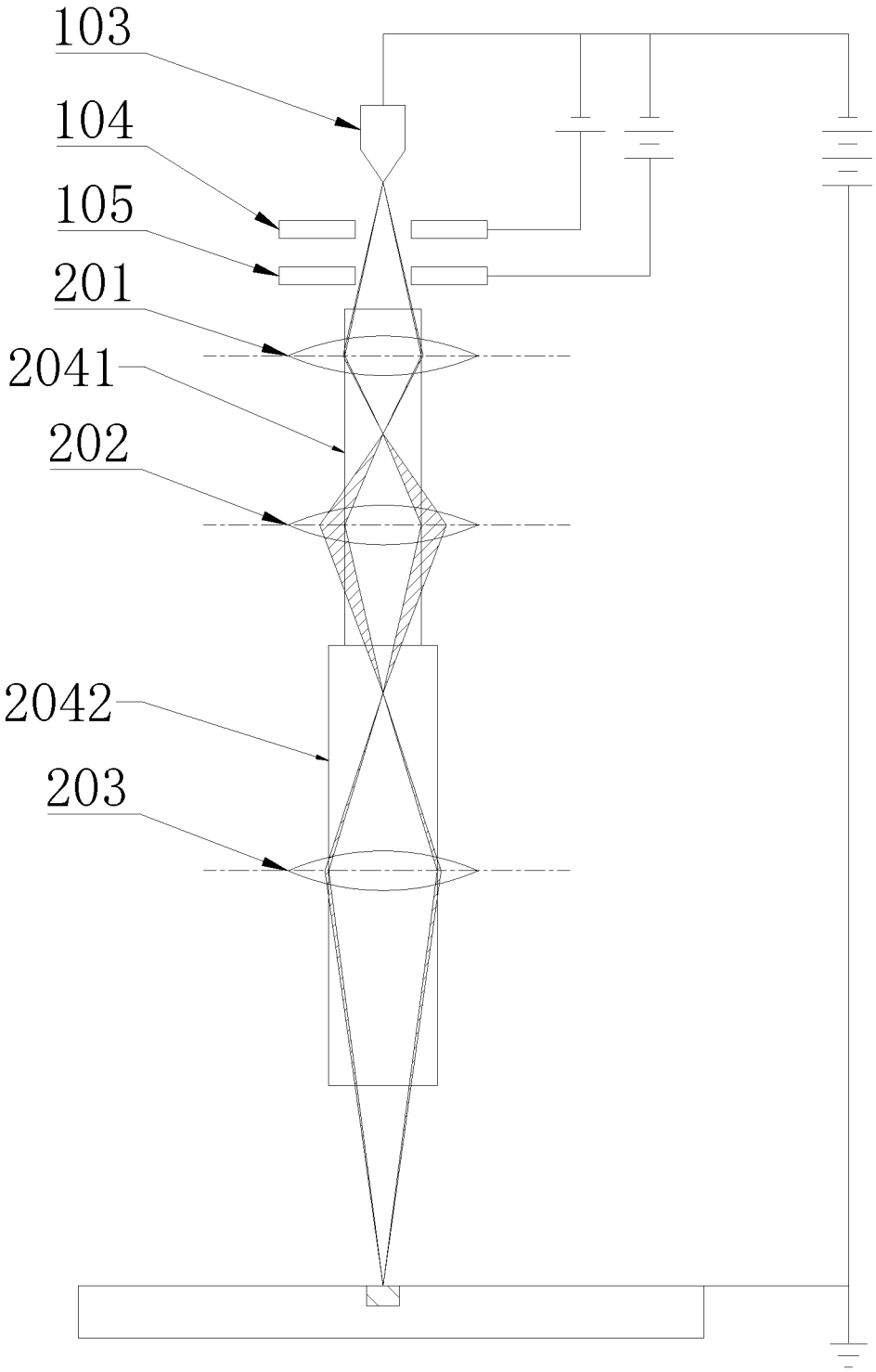
FIG. 6 is a schematic diagram showing the electron beam system in the rotary-transmission-target microfocus X-ray source according to the present disclosure.

Referring to FIGS. 3-5, in the embodiment of the present disclosure, the rotary anode target 301 system includes the bevel gear transmission device 304 installed in the chamber. The motor 302 drives a driving bevel gear to rotate. A driven bevel gear drives the anode target 301 to rotate. The driven bevel gear drives an anode target rotating shaft to rotate and then the anode target rotating shaft drives the anode target 301 to rotate. Specifically, the motor 302 adopts a high-precision stepping motor, and the high-precision stepping motor 302 is installed at the top of the third chamber 300 to provide a driving force for the rotation of the anode target 301 through the bevel gear transmission device 304. Specifically, the rotary anode target 301 system also includes a magnetic fluid seal 303 configured to provide dynamic vacuum sealing for the transmission shaft connected to the high-precision stepping motor 302.

Specifically, the bevel gear transmission device 304 adopts spiral bevel gears with a curved tooth line and a helix angle, which reduces the influence of the self-excited vibration generated by gear meshing on the structural shape of the electron beam focus on the first surface 3011 of the anode target. The bevel gears are gears with a larger modulus, which can also reduce the self-excited vibration generated by gear meshing. The high-precision stepping motor 302 can maintain the rotation speed of the rotary anode target 301 at a relatively high level. When the device operates normally, the rotation speed of the anode target 301 can be maintained at 100 r/min or above.

The anode target 301 of the present disclosure includes a thermally conductive base 3012 on which a metal target 3013 is arranged. Specifically, the metal target 3013 is arranged on the first surface 3011 of the thermally conductive base 3012. The metal target 3013 is facing the central axis of the focusing lens, and the width of the metal target 3013 is between 1 μm and 10 μm, and preferably the width of the metal target 3013 is 1 μm. An electron beam generated by the cathode tip is accelerated by an accelerating voltage, then compressed by the focusing lenses and focused on the metal target 3013 on the anode target 301, and works together with the metal target 3013 to generate X-rays. The thermally conductive base 3012 is disc-shaped. In the embodiment of the present disclosure, the thermally conductive substrate 3012 and the metal target 3013 are made of different materials. The thermally conductive base material should have a thermal conductivity of at least 30 W/(m·K). Preferably, the material includes diamond, and alternative materials include but are not limited to graphite, silicon carbide, silicon nitride, a high-temperature ceramic composite material, and the like. The metal target 3013 has a ring structure, is embedded in the surface of the thermally conductive base 3012 along the circumferential direction of the thermally conductive base 3012, and is thermally connected with the thermally conductive base 3012. The material of the thermally conductive base 3012 has a thickness ranging from 100 μm to 1000 μm. Preferably, the material of the thermally conductive base 3012 is 250 μm thick. The metal target 3013 has a thickness ranging from 5 μm to 50 μm. Preferably, the metal target 3013 is 10 μm thick. The material of the metal target should at least generate X-rays with a predetermined energy spectrum when bombarded by the electron beam. Preferably, the material includes tungsten. Alternative materials include but are not limited to chromium, copper, aluminum, rhodium, molybdenum, gold, platinum, iridium, cobalt, tantalum, titanium, rhenium, tantalum carbide, titanium carbide, and alloys or combinations comprising one or more of the foregoing.

The present disclosure provides two methods for realizing microfocus high-resolution imaging. The first method can focus the electron beam through the electron-optical system, so that the focal spot size is between 0.5 μm and 30 μm when the electron beam reaches the first surface 3011 of the anode target, thus realizing microfocus high-resolution imaging.

The second method can achieve the ideal effective interaction area between the electron beam and the metal target 3013 by specifying the width of the metal target 3013 on the first surface 3011 of the anode target. When the linear focal spot works, the length direction of the linear focal spot is vertical to the tangential direction of the metal target 3013, and the width of the metal target 3013 ranges from 1 μm to 10 μm, thereby realizing microfocus high-resolution imaging.

In the present disclosure, an X-ray window 306 is arranged at the front end of the third chamber 300, and the X-rays generated by the interaction between the rotary anode target 301 and the electron beam pass through the X-ray window 306 vertically. The material of the X-ray window 306 should at least have a low absorption rate of X-rays and have a certain strength. In the embodiment of the present disclosure, the material of the X-ray window 306 is diamond. In another embodiment of the present disclosure, the material of the X-ray window 306 includes but is not limited to beryllium, silicon, boron nitride, silicon carbide and other low atomic number materials or composite materials.

In the embodiment of the present disclosure, the X-ray window 306 has a thickness of 70 μm. In another embodiment of the present disclosure, the X-ray window 306 has a thickness ranging from 30 μm to 1500 μm.

In the embodiment of the present disclosure, the cooling system includes a cooling chamber 305 installed in the chamber, a cooling medium is arranged in the cooling chamber 305, and a water chiller is connected with the cooling chamber 305 and circulates the cooling medium. Specifically, the cooling system further includes a sealed water pipe, and the sealed water pipe is connected with the cooling chamber 305 and the water chiller. The cooling chamber 305 cools the anode target 301. Specifically, the cooling chamber 305 cools the metal target 3013 of the anode target 301.

In the embodiment of the present disclosure, when the chamber adopts an open design, the device is equipped with a vacuum system. The vacuum system mainly includes a vacuum pump unit, a vacuum gauge, a sealing ring and the like. The vacuum pump unit includes a backing mechanical pump and a turbomolecular pump. The backing mechanical pump is located outside the device, and the turbomolecular pump is located at the top of the first chamber 100 of the device and connected to the first chamber 100 through a flange. The vacuum system provides an ultra-high vacuum environment not lower than $1\times10^{-6}$ Pa for the first chamber 100, the second chamber 200, and the third chamber 300. The vacuum gauge is embedded in the chamber through the flange at the top of the first chamber 100 of the device to detect the vacuum environment.

In the embodiment of the present disclosure, the vacuum pump unit maintains the vacuum degree in the vacuum chamber higher than $1\times10^{-6}$ Pa. In another embodiment of the present disclosure, the vacuum pump unit maintains the vacuum degree in the vacuum chamber between $1\times10^{-9}$ Pa and $1\times10^{-2}$ Pa.

Figure 8:
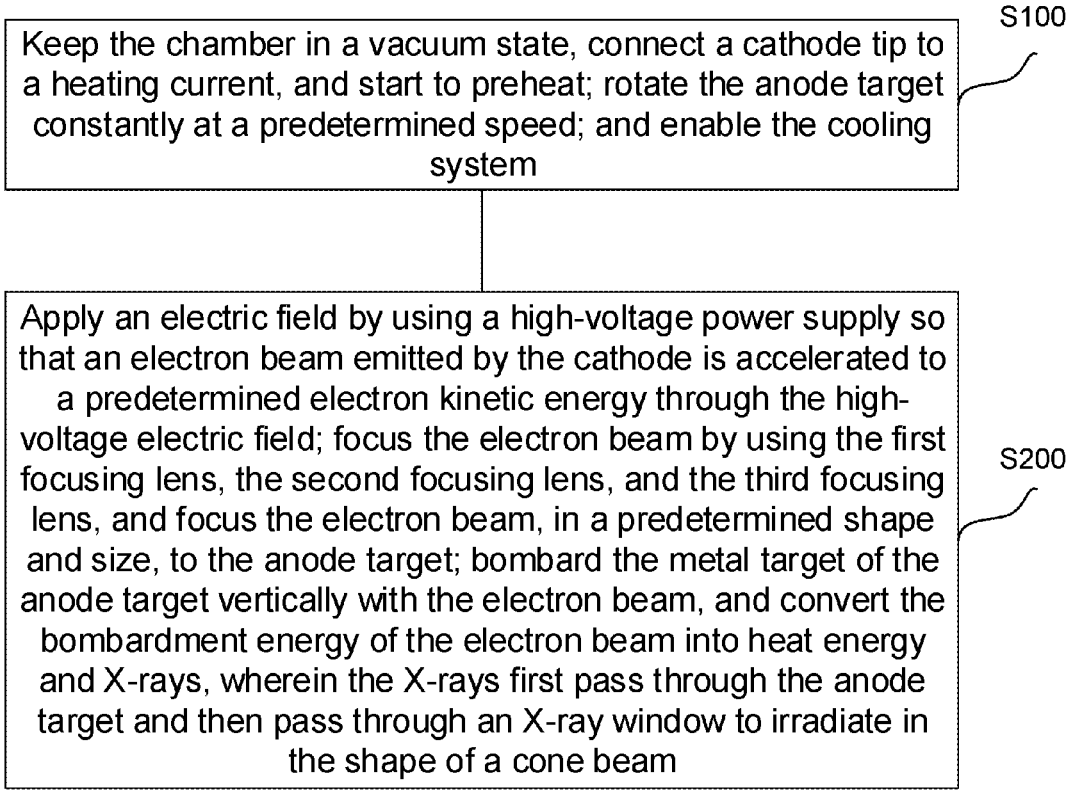
FIG. 8 is a flow chart showing an X-ray generation method based on a rotary-transmission-target microfocus X-ray source according to the present disclosure.

As shown in FIG. 8, an embodiment of the present disclosure provides an X-ray generation method based on a rotary transmission target microfocus X-ray source. The method uses the rotary transmission target microfocus X-ray source. The method includes:

S100, keeping the chamber in a vacuum state, connecting the cathode tip 103 to a heating current, and starting to preheat; rotating the anode target 301 constantly at a predetermined speed; and enabling the cooling system; and S200, applying an electric field by using a high-voltage power supply so that an electron beam emitted by the cathode tip is accelerated to a predetermined electron kinetic energy through the high-voltage electric field; focusing the electron beam by using the first focusing lens 201, the second focusing lens 202, and the third focusing lens 203, and focusing the electron beam, in a predetermined shape and size, to the anode target 301; bombarding the metal target 3013 of the anode target 301 vertically with the electron beam, and converting the bombardment energy of the electron beam into heat energy and X-rays, wherein the X-rays first pass through the anode target 301 and then pass through the X-ray window 306 to irradiate in the shape of a cone beam.

In step S100, when the device of the embodiment of the present disclosure is in operation, the backing mechanical pump is first turned on, and the vacuum chamber is vacuumized by the backing mechanical pump to a vacuum degree of $1\times10^{-2}$ Pa or above. The turbomolecular pump is then turned on, and the vacuum chamber is vacuumized to a vacuum degree of $1\times10^{-6}$ Pa or above, and this vacuum degree is maintained until the device stops operating.

In step S100, the rotation speed of the anode target 301 is maintained at 100 r/min or above.

In step S100, the water chiller is turned on, and the cooling medium begins to circulate.

Specifically, the X-ray generation method based on a rotary transmission target microfocus X-ray source in the embodiment of the present disclosure is controlled by a control system and is automated.

The present disclosure overcomes the shortcoming of a transmission target X-ray source having low imaging efficiency during high-resolution imaging and the shortcomings of a Reflecting target X-ray source, such as low resolution and poor image quality during fast imaging, are overcome. The device improves the imaging resolution and the brightness and X-ray flux of the X-ray source, thereby improving the imaging efficiency and reducing the imaging time. Specifically, 1. Based on the light emitting principle of the transmission target X-ray source, the electron beam is focused by the electron-optical system, thereby reducing the focal spot diameter, realizing microfocus, improving the imaging resolution, and increasing the X-ray emission angle.
2. The anode target 301 rotates while the electron beam bombards the target, which increases the heat dissipation volume, improves the heat dissipation efficiency and the power of the anode target 301. The cooling system is installed at the anode target 301, which improves the heat dissipation efficiency and the power of the anode target 301.
3. Bevel gear transmission is used to eliminate the influence of the magnetic field generated by an electromagnetic coil in a driving device (the high-precision stepping motor 302) on the trajectory of the electron beam. Moreover, due to the adoption of the design where the anode target rotating shaft and the electron beam system are arranged on the same side, the X-ray window 306 of the ray source can get close to a sample, avoiding unnecessary X-ray intensity attenuation.
4. The ring structure on the first surface 3011 of the anode target 301 can prevent the structural shape of the portion on which the electron beam acts from changing with the rotation of the anode target 301, thereby ensuring the stability of light emission.
5. Due to adoption of magnetic-fluid dynamic sealing, the high-precision motor 302 can drive the rotary anode target 301 to rotate at a high speed while maintaining a high vacuum degree, thereby ensuring that the device can work for a long time without damage.
6. The device can adopt a three-stage open design, which is convenient for the replacement of consumables and the installation and maintenance of components. A closed design can also be adopted to ensure the stability of the working environment of the electron beam system in the vacuum chamber.

In the above solutions, the present disclosure adopts the light emitting principle of the transmission target X-ray source and uses the electron-optical system to focus the electron beam, thereby reducing the focal spot diameter, improving the imaging resolution, and increasing the X-ray emission angle. The anode target rotates while the electron beam bombards the target, which increases the effective heat dissipation volume and improves the heat dissipation efficiency and the power of the anode target. A cooling system is installed at the anode target, which further improves the heat dissipation efficiency and the power of the anode target. The shortcoming of a transmission target X-ray source having low imaging efficiency during high-resolution imaging and the shortcomings of a reflecting target X-ray source, such as low resolution, poor image quality and the like during fast imaging, are overcome. The present disclosure improves the imaging resolution and the brightness and X-ray flux of the X-ray source, and reduces the imaging time. Bevel gear transmission is used to eliminate the influence of the magnetic field generated by an electromagnetic coil in a driving device (high-precision stepping motor) on the trajectory of the electron beam. Moreover, due to the adoption of the design where the rotor and the electron beam system are arranged on the same side, the X-ray window of the ray source can get close to a sample, avoiding unnecessary X-ray intensity attenuation.

The preferred embodiments are described as above. It should be noted that for the person of ordinary skill in the art, several improvements and modifications also may be made without departing from the principles of the disclosure, and these improvements and modifications also should be considered as falling within the scope of the disclosure.

What is claimed is:

1. A rotary-transmission-target microfocus X-ray source used in a X-ray generation method, the rotary-transmission-target microfocus X-ray source comprising: a chamber, wherein an electron beam system, a rotary anode target system and a cooling system are installed in the chamber, the electron beam system is arranged on a same side as an anode target rotating shaft in the rotary anode target system, a motor in the rotary anode target system drives an anode target to rotate through a bevel gear transmission device, an electron beam emitted by the electron beam system vertically bombards a metal target of the anode target, and the cooling system is configured to cool the anode target; and the method comprising:

keeping the chamber in a vacuum state, connecting a cathode tip to a heating current, and starting to preheat; rotating the anode target constantly at a predetermined speed; and enabling the cooling system; and applying an electric field by using a high-voltage power supply so that an electron beam emitted by the cathode is accelerated to a predetermined electron kinetic energy through the high-voltage electric field; focusing the electron beam by using a first focusing lens, a second focusing lens, and a third focusing lens, and focusing the electron beam, in a predetermined shape and size, to the anode target; bombarding the metal target of the anode target vertically with the electron beam, and converting the bombardment energy of the electron beam into heat energy and X-rays, wherein the X-rays first pass through the anode target and then pass through an X-ray window to irradiate in the shape of a cone beam.

2. The rotary-transmission-target microfocus X-ray source according to claim 1, wherein the electron beam system comprises a ceramic base and a channel member, a high-voltage tube head is connected to and installed at a rear end of the ceramic base, a cathode, a first anode, and a second anode are sequentially installed coaxially at a front end of the ceramic base, a first focusing lens and a second focusing lens are sequentially installed at a rear end of the channel member, a third focusing lens is installed at a front end of the channel member, all the focusing lens are coaxially arranged, and an electron beam channel coaxial with the cathode is arranged in the channel member.

3. The rotary-transmission-target microfocus X-ray source according to claim 2, wherein the channel member comprises a first channel member, a second channel member is installed at a front end of the first channel member, the first focusing lens and the second focusing lens are fitted over the first channel member, and the third focusing lens is fitted over a front end of the second channel member;

a first electron beam channel is arranged in the channel member, a second electron beam channel is arranged in the second channel member, and the electron beam channels are coaxially connected.

4. The rotary-transmission-target microfocus X-ray source according to claim 1, wherein the rotary anode target system comprises the bevel gear transmission device installed in the chamber, the motor drives a driving bevel gear to rotate, and a driven bevel gear drives the anode target to rotate.

5. The rotary-transmission-target microfocus X-ray source according to claim 1, wherein the anode target comprises a thermally conductive substrate, and the metal target is arranged on the thermally conductive substrate.

6. The rotary-transmission-target microfocus X-ray source according to claim 1, wherein the chamber is configured as a one-piece structure.

7. The rotary-transmission-target microfocus X-ray source according to claim 1, wherein the chamber comprises at least two chamber bodies that are detachably connected, and a vacuum system is connected with and installed on the chamber bodies.

8. The rotary-transmission-target microfocus X-ray source according to claim 1, further comprising a control system.

9. The rotary-transmission-target microfocus X-ray source according to claim 1, wherein the cooling system comprises a cooling chamber installed in the chamber, a cooling medium is arranged in the cooling chamber, and a water chiller is connected with the cooling chamber and circulates the cooling medium.

* * * * *